US005901505A

United States Patent [19]

Dettmann et al.

[11] Patent Number: 5,901,505

[45] Date of Patent: May 11, 1999

[54] PORTABLE RISER

[75] Inventors: Thomas A. Dettmann, New Prague; Mark E. Gallea, Owatonna; David R. Boeddeker, Owatonna; Leslie R. Abraham, Owatonna, all of Minn.

[73] Assignee: Wenger Corporation, Owatonna, Minn.

[21] Appl. No.: 09/054,691

[22] Filed: Apr. 3, 1998

Related U.S. Application Data

[62] Division of application No. 08/664,241, Jun. 7, 1996, Pat. No. 5,787,647.

[51] Int. Cl.[6] ..... E04H 3/28

[52] U.S. Cl. ..... 52/6; 52/7; 52/64; 52/183; 52/311.2; 52/483.1

[58] Field of Search ..... 52/7, 64, 311.2, 52/483.1, 489.1, 489.2, 183, 6; 108/92, 97, 99, 124, 157.13, 158, 158.13; D25/4, 12, 32

[56] References Cited

U.S. PATENT DOCUMENTS

| | | | |
|---|---|---|---|
| Re. 19,373 | 11/1934 | Wetzel . | |
| Re. 30,830 | 12/1981 | Wenger et al. . | |
| D. 304,499 | 11/1989 | Rogers et al. . | |
| D. 307,186 | 4/1990 | Rogers et al. . | |
| 445,629 | 2/1891 | Osgood . | |
| 1,715,885 | 6/1929 | Annand et al. . | |
| 1,800,610 | 4/1931 | Edwards . | |
| 1,823,484 | 9/1931 | Blumenthal . | |
| 2,054,960 | 9/1936 | Adamson . | |
| 2,061,235 | 11/1936 | Horn . | |
| 2,147,564 | 2/1939 | Vance . | |
| 2,205,624 | 6/1940 | Horn . | |
| 2,263,058 | 11/1941 | Weilert | 108/97 |
| 2,362,170 | 11/1944 | Swaisgood . | |
| 2,585,763 | 2/1952 | Gasner et al. . | |
| 2,588,783 | 3/1952 | Wetzel . | |
| 2,624,590 | 1/1953 | Tilton . | |
| 2,704,383 | 3/1955 | Berg | 52/183 |
| 2,717,631 | 9/1955 | Howe . | |
| 2,780,506 | 2/1957 | Howe . | |
| 2,798,652 | 7/1957 | Easton . | |
| 2,841,831 | 7/1958 | Mackintosh . | |
| 2,983,968 | 5/1961 | Wurn . | |
| 3,103,707 | 9/1963 | Lappin et al. . | |
| 3,142,871 | 8/1964 | Harms . | |
| 3,593,821 | 7/1971 | Lister . | |
| 3,620,564 | 11/1971 | Wenger . | |
| 3,747,706 | 7/1973 | Paine et al. . | |

(List continued on next page.)

OTHER PUBLICATIONS

Catalog entitled "Stage Right—1994 Portable Staging, Risers and Acoustical Shells Catalog".

Text entitled "Mechanism Design—Analysis and Synthesis", vol. I, Arthur G. Erdman/George N. Sandor.

SICO® Mobile Folding Choral Risers four page text.

*Primary Examiner*—Christopher Kent

*Attorney, Agent, or Firm*—Patterson & Keough, P.A.

[57] ABSTRACT

The choral riser of the present invention is adapted to be supported on a stage surface. The choral riser has a base that presents two spaced apart base supports, each of the base support having a first and a second spaced apart pivot point. A first step member has a step pivot point and a base pivot point that is operably pivotally coupled at the base pivot point to the base at the base first pivot point and has at least one step presented thereon. A second step member has a step pivot point and a link pivot point that is operably pivotally coupled at the step pivot point to the first step member at the first step member step pivot point and has a plurality of steps presented thereon. A bar link member is operably pivotally coupled at a first end pivot point to the second step member bar link pivot point. The bar link member is operably pivotally coupled at a second end pivot point to the base second pivot point. The first and second step members are pivotable between a stowed configuration, with at least one of the steps of the first step member facing at least one of the steps of the second step member, and an operational configuration in which the steps of the first and second step members present an ascending succession of steps. The steps are readily reversible to change the stage presentation form.

13 Claims, 8 Drawing Sheets

U.S. PATENT DOCUMENTS

| | | | |
|---|---|---|---|
| 3,747,708 | 7/1973 | Wenger et al. . | |
| 3,748,798 | 7/1973 | Mackintosh . | |
| 3,869,835 | 3/1975 | Mackintosh . | |
| 3,908,787 | 9/1975 | Wenger et al. . | |
| 3,914,909 | 10/1975 | McNeal . | |
| 3,934,281 | 1/1976 | Brindisi . | |
| 4,011,695 | 3/1977 | Simmons, Sr. . | |
| 4,327,650 | 5/1982 | Bue . | |
| 4,361,991 | 12/1982 | Wiese . | |
| 4,412,403 | 11/1983 | LeFranc et al. . | |
| 4,611,439 | 9/1986 | Graham, Jr. . | |
| 4,768,617 | 9/1988 | Mason et al. . | |
| 4,917,217 | 4/1990 | Rogers et al. . | |
| 4,949,649 | 8/1990 | Terres et al. . | |
| 4,979,340 | 12/1990 | Wilson et al. . | |
| 5,050,353 | 9/1991 | Rogers et al. . | |
| 5,323,563 | 6/1994 | Rogers et al. | 52/7 |
| 5,349,789 | 9/1994 | Andert et al. | 52/7 |
| 5,464,236 | 11/1995 | Benting et al. . | |

PORTABLE RISER

This is a Division of application Ser. No. 08/664,241 filed Jun. 7, 1996, now U.S. Pat. No. 5,787,647.

TECHNICAL FIELD

The present invention relates to a portable riser for use in performances such as choral presentations. More particularly, the present invention relates to a portable riser that is readily pivoted between a stowed configuration and an operational configuration and is readily alterable to define a plurality of stage presentation forms with a plurality of portable risers.

BACKGROUND OF THE INVENTION

Risers are typically assembled on a stage for choral presentations. Due to the multiple uses to which the staging area is put, the need for the risers is generally only for the duration of the choral presentation. Accordingly, it is desirable that such risers are easily set up in a sturdy, operational configuration suitable for delivering a choral presentation. Additionally, such risers must also be easily disassembled and stored in the minimal amount of space possible. The risers should be easily movable from the stage area to a remote storage area through normal sized doorways. Further, when assembling a stage presentation form using a plurality portable risers, it is desirable to have the flexibility to utilize the portable risers to define a plurality of stage presentation forms, such as for example, a presentation form that has a straight center portion with inward curved end portions, a straight presentation form, or a curved presentation form.

Examples of existing designs of foldable staging devices include the telescoping platform structure depicted in U.S. Pat. No. 3,400,502 to R. T. Schaggs et al. U.S. Pat. No. 5,050,353 to Rogers et al. depicts a riser in which the frame is interconnected by collapsible gates that permit the entire frame to collapse for storage. U.S. Pat. No. Des. 307,186 to Rogers et al. depicts a hinged three tier riser in which the entire tier of steps may be raised to a stowed position. U.S. Pat. No. 3,747,706 to Paine et al. depicts a collapsible riser in which both the steps and the guard rail collapse and the entire apparatus is tipped on end for transport to a storage area. U.S. Pat. No. Re. 30,830 to Wenger et al. depicts a portable riser that collapses from an erect operational configuration to a stowed configuration using a bilateral folding action. U.S. Pat. No. 4,979,340 to Wilson et al. depicts a folding riser having a main frame that supports the guard rail and secondary frame that supports the steps, wherein the secondary frame is foldable onto the primary frame for storage.

While the above examples of prior staging devices have certain merits, the requirement for a sturdy, simple, easily collapsible, and compact riser that includes the flexibility of quickly changing the presentation form has been the focus of continuing industry efforts.

SUMMARY OF THE INVENTION

The present invention substantially meets the aforementioned requirements. The present invention is considerably simplified as compared to the multi-link structures necessary to effect collapsing to a stowed position in the prior art. Such simplification minimizes the friction and binding that develops in multi-link systems and enables a single person to move the present invention from the stowed configuration to the operational configuration and back to the stowed configuration with relative ease.

Additionally, there is a certain degree of parts compatibility between a three and a four step design as shown herein. In both designs, the upper and lower step members and the base components are identical in both designs, thereby minimizing the production costs of the two embodiments. The linkage system that accommodates the ready pivotal transition between the operational and stowed configurations is also common to both embodiments.

Further, the riser of the present invention is narrow enough and low enough when in the stowed configuration to be readily moved through a doorway of standard width and height to facilitate moving the riser off stage for remote storage of the riser.

Further, in a preferred embodiment, the riser of the present invention has steps that are all trapezoidal in planform. The steps are readily removable and reversible to permit a plurality of risers to be assembled on a stage in widely varying presentation forms.

The choral riser of the present invention is adapted to be supported on a stage surface. The choral riser has a base that presents two spaced apart base supports, each of the base supports having a first and a second spaced apart pivot point. A first step member has a step pivot point and a base pivot point that is operably pivotally coupled at the base pivot point to the base at the base first pivot point and has at least one step presented thereon. A second step member has a step pivot point and a link pivot point that is operably pivotally coupled at the step pivot point to the first step member at the first step member step pivot point, and has a plurality of steps presented thereon. A bar link member has a first and second end. The bar link first end has a pivot point and the bar link second end has a pivot point. The bar link member is operably pivotally coupled at the first end pivot point to the second step member bar link pivot point. The bar link member is also operably pivotally coupled at the second end pivot point to the base second pivot point. The first and second step members are pivotable between a stowed configuration, with at least one of the steps of the first step member facing at least one of the steps of the second step member, and an operational configuration in which the steps of the first and second step members present an ascending succession of steps.

DETAILED DESCRIPTION OF THE DRAWINGS

Figure 1:
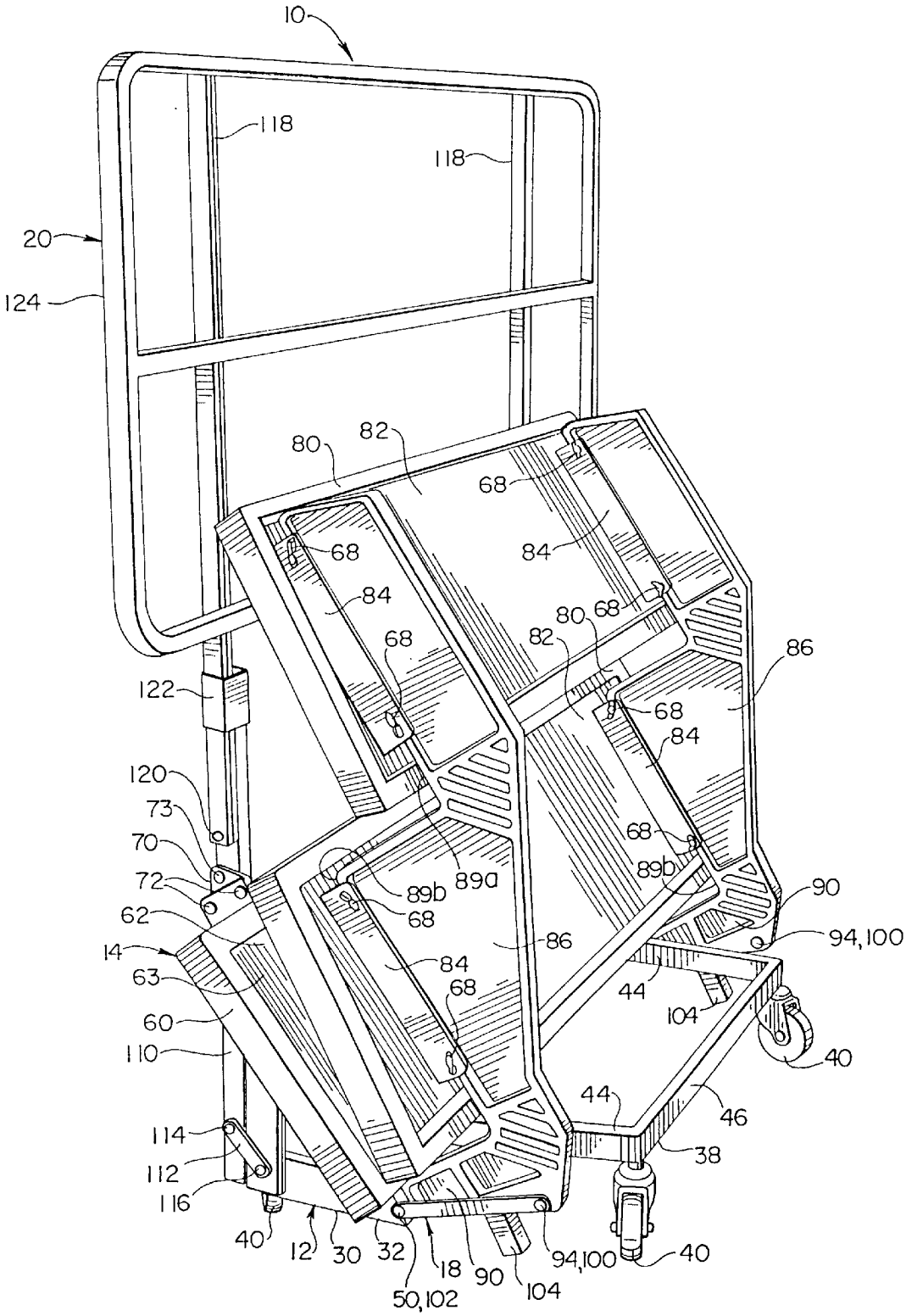
FIG. 1 is front perspective view of the three step embodiment of the present invention in the stowed configuration.

There are two embodiments of the present invention depicted. FIGS. 1–5 depict a three step embodiment of the riser 10 and FIGS. 6–10 depict a four step embodiment of the riser 10'. Both of the embodiments of the riser 10 and 10' broadly include a base 12, first step member 14, second step member 16, bar link 18, and guard rail 20, with like components in the two embodiments annotated with like numbers. The main differences in the two embodiments of the riser 10 and the riser 10' are the number of steps, and the linkage system necessary for the deployment of the guard rail 20 to accommodate the differing number of steps.

Figure 2:
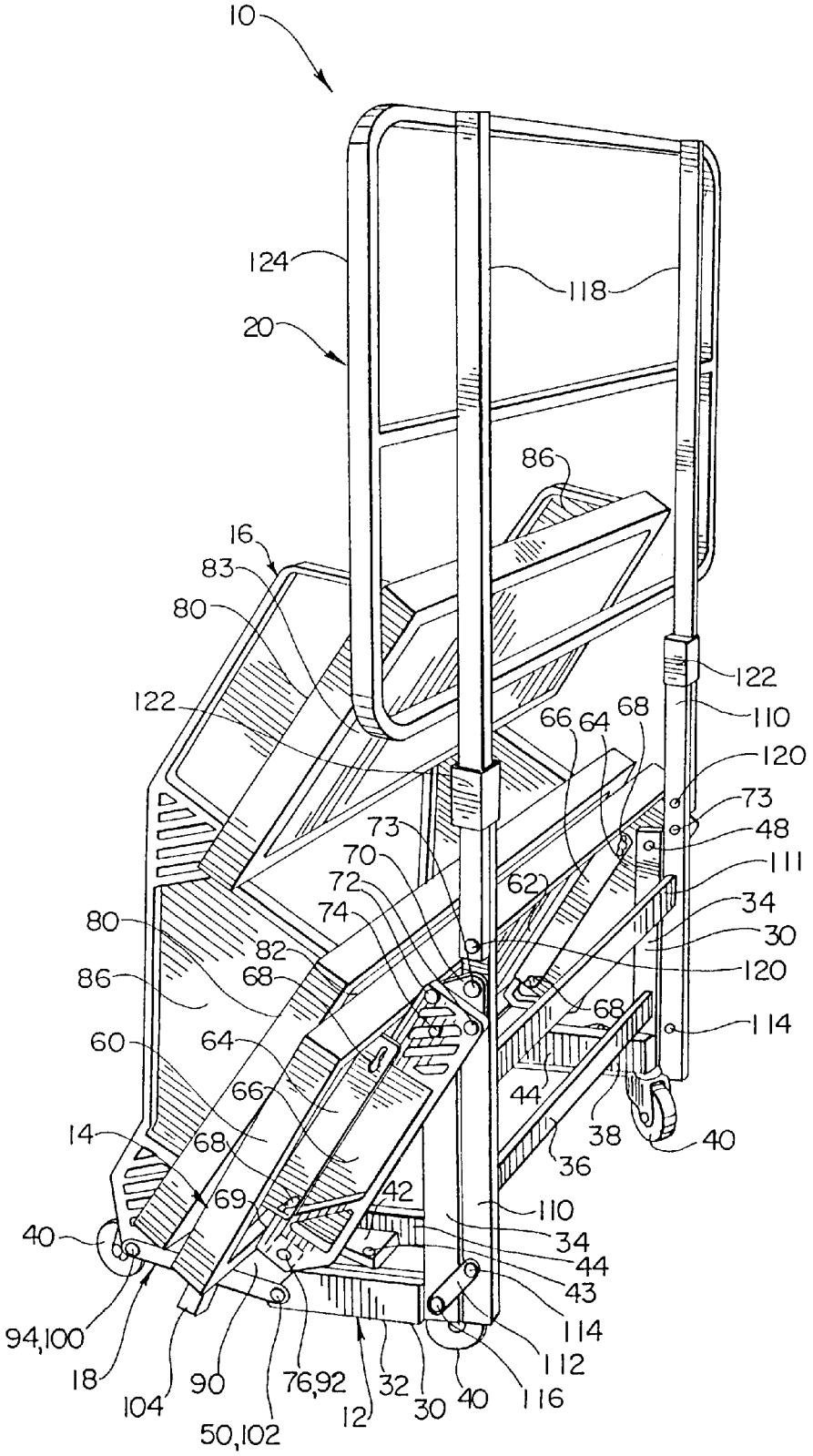
FIG. 2 is a rear perspective view of the embodiment depicted in FIG. 1 in the stowed configuration.

Referring to FIGS. 1–5 and more particularly, to FIGS. 1 and 2, the base 12 of the riser 10 has two parallel and spaced apart base supports 30. The base supports 30 are formed in a generally L-shape, having a horizontal first support leg 32 and a vertical second support leg 34. A cross member 36 extends substantially the full width of the riser 10, connecting the two base supports 30 and providing for the structural integrity of the base 12.

An enclosed castor frame 38 is disposed between the two base supports 30. The castor frame 38 supports four castors 40. The castor frame 38 is fixedly coupled to the two base supports 30 by means of gussets 42 and bolts 43. The castor frame 38 is alternatively formed integral with the two base supports 30 by weldments. The castor frame 38 is formed of side supports 44 and front support 46 is depicted in FIG. 1. Referring to FIG. 2, the side supports 44 are welded to the underside of cross member 36, thereby enclosing the castor frame 38.

Figure 3:
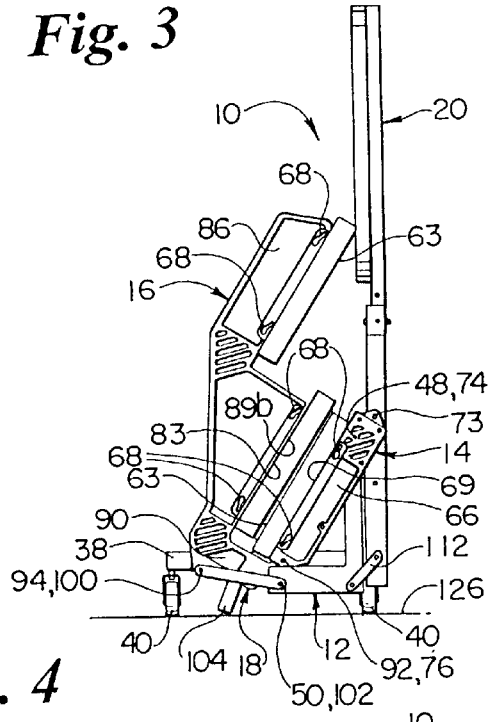
FIG. 3 is a side elevational view of the three step embodiment in the stowed configuration.
Figure 5:
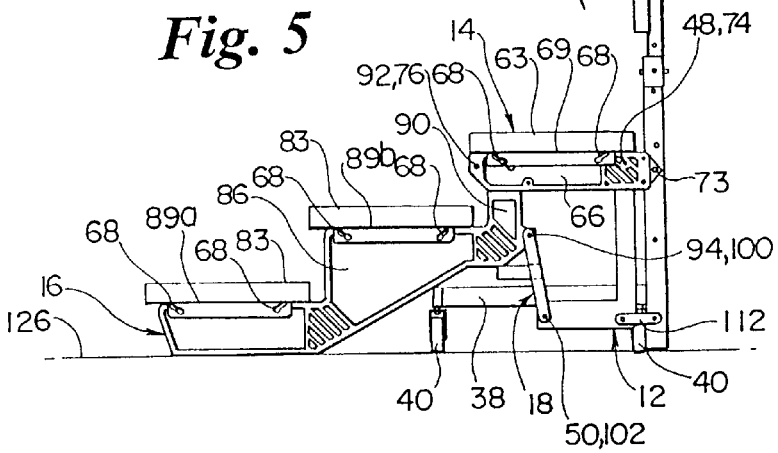
FIG. 5 is a side elevational view of the three step embodiment in the operational configuration.

The base supports 30 comprise the first component of two multi-bar linkage systems that permit the pivotal folding of the riser 10 between a stowed configuration, depicted in FIGS. 1–3, wherein the first and second step members 14, 16 are disposed substantially on top of base 12, and an extended operational configuration, depicted in FIG. 5, in which performers may stand upon the ascending steps of the riser 10. There is a substantially identical multi-bar linkage system formed at each of the two sides of the riser 10 that work cooperatively to pivot the riser 10 between the operational and stowed configurations.

Each of the components that are part of the multi-bar linkage system have two spaced apart pivot points with a bar of the linkage system extending between the two pivot points. Accordingly, each of the base supports 30 of the base 12 has a first base pivot point 48 and a second base pivot point 50. The distance between the first base pivot point 48 and the second base pivot point 50 comprises the first bar of the linkage system. As depicted in FIGS. 1 and 2, the first base pivot point 48 is located proximate the upper margin of the vertical second support leg 34. The second base pivot point 50 is located proximate the forward margin of the horizontal first support leg 32.

The second component of the riser 10 is the first step member 14. In the embodiment depicted in FIGS. 1–5, the first step member 14 comprises the uppermost and rearmost step of the riser 10 when the riser 10 is in the extended operational configuration. The first step member 14 consists of a single step, being the third step of the riser 10.

The first step member 14 has a step frame 60. The step frame 60 is preferably formed in a closed trapezoidal shape and is preferably constructed of box channel metal components. The step frame 60 is formed in a rectangular shape in instances where the desired step shape is rectangular. The step frame 60 supports a step 62 which may be made of wood and carpeted as desired on its upper performing surface 63.

The first step member 14 has a U-shaped channel bracket 64 proximate the two side margins thereof. Each channel bracket 64 is affixed to the underside of the step 62 and is bolted to a pivoting support 66 by toggle bolts 68. The pivoting supports 66 provide the main structural support for the first step member 14 when the riser 10 is deployed in its operational configuration, supporting the step 62 on an upwardly directed support surface 69. In such configuration, the support surface 69 is in a substantially parallel relationship to the floor on which the riser 10 is resting. The two pivoting supports 66 are generally disposed in a parallel and spaced apart relationship.

Figure 11:
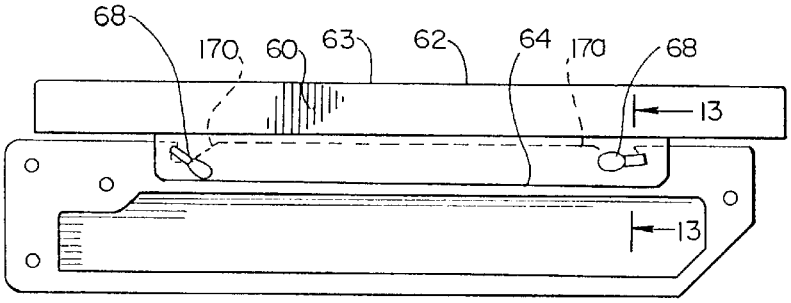
FIG. 11 is a side elevational view of a step removably coupled to a step support.
Figure 12:
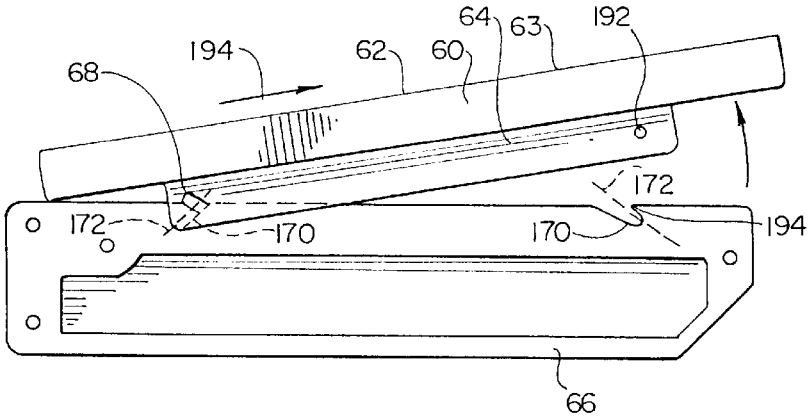
FIG. 12 is a side elevational view of a step being removed from the step support.
Figure 13:
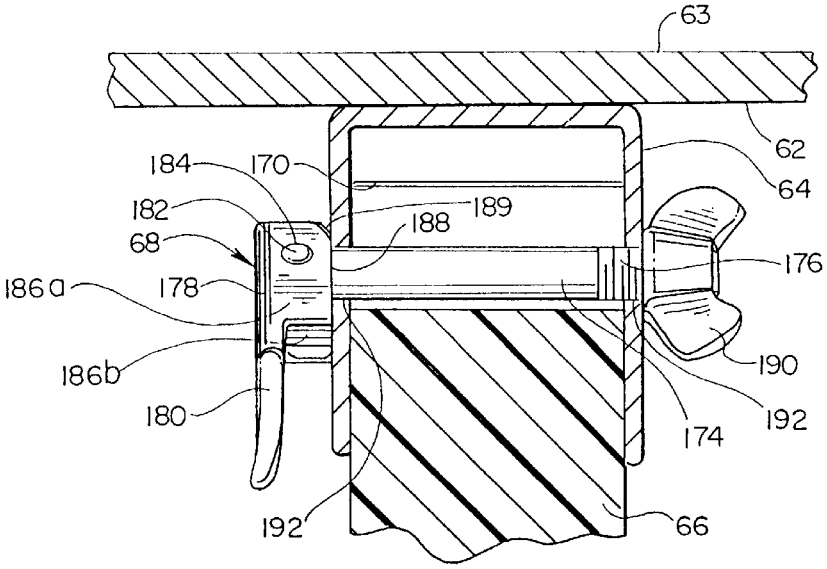
FIG. 13 is a sectional view of the step and support taken along line 13—13 in FIG. 11 depicting the toggle bolt connector.

Referring to FIGS. 11–13, the upwardly directed support surface 69 of the pivoting support 66 has two toggle bolt receivers 170 defined therein. The toggle bolt receivers 170 are disposed at an acute included angle with respect to the support surface 69 such that a centerline 172, defined in the receivers 170, is not orthogonally disposed with respect to the support surface 69.

The toggle bolt 68 has an elongate shank 174, having threads 176 formed at the distal end thereof. An over-center toggle 178 is disposed at the other end of the toggle bolt 68. The toggle 178 has a handle 180 to facilitate the locking and unlocking of the toggle bolt 68. The handle 180 is pivotally affixed to the shank 174 by a spring pin 182. The spring pin 182 is supported in two bores 184, defined in parallel ears 186*a*, 186*b* of the handle 180, and by a bore (not shown) defined through the shank 174.

The handle 180 has a cam surface 188 that bears upon the side of the channel bracket 64 when the toggle bolt 68 is in the locked configuration. The corner 189 adjacent to the cam surface 188 acts as the high point of the cam, the cam surface 188 being the low point. A butterfly nut 190 is threadedly engaged with the threads 176 of the shank 174. The butterfly nut 190 is typically tightened down only finger tight.

In order to secure the step 62 to the pivoting support 66, the shank 174 of the toggle bolt 68 is passed through bores 192 that are in registry in the sides of the channel bracket 64 and through the receiver 170. The toggle bolt 68 is retained in position in the receiver 170 by the lip 194 of the receiver 170. Prior to securing the toggle bolt 68, the toggle bolt 68 is held in the unlocked configuration with the handle 180 oriented generally coaxially with the shank 174. The butterfly nut 190 is then snugged up against the channel bracket 64. The handle 180 is then rotated approximately slightly more than ninety degrees into the locked, over center configuration. This rotation causes the high point of the cam, the corner 189 to first bear upon the channel bracket 64.

Rotation is continued past the corner 189 until the cam surface 188 bears upon the side of the channel bracket 64, compressively holding the channel bracket 64 to the pivoting support 66 and compressively holding the toggle bolt 68 in the locked configuration.

Referring again to FIGS. 1–5, a relatively short, generally triangular shaped guard rail bracket 70 is fixedly joined to the pivoting support 66 by bolts 72. The guard rail bracket 70 is utilized only in the three step embodiment of the riser 10, depicted in FIGS. 1–5. The guard rail bracket 70 forms an upper parallel link for the deployment of the guard rail 20, as will be later described. The link is formed between a guard rail pivot point 73 formed in the guard rail bracket 70 and a pivoting support 66 first pivot point 74.

The first step member 14 comprises the second bar of the linkage system. Accordingly, as depicted in FIG. 2, each pivoting support 66 has the first pivot point 74 defined therein. The first pivot point 74 is in registry with the first base pivot point 48 of the base 12. The pivoting support 66 is pivotally coupled to the base support 30 by a suitable bolt that passes through a bolt hole (not shown) at the first pivot point 74 of the pivoting support 66 and thence through the first base pivot point 48 of the base support 30.

Each pivoting support 66 has a second pivot point 76 spaced apart from the first pivot point 74. The second pivot point 76 is located proximate the forward end of the pivoting support 66 when the riser 10 is in the operational configuration and close to the underside of the step 62.

The third component of the riser 10 is the second step member 16. The second step member 16 is substantially identical in both the three step embodiment, riser 10 depicted in FIGS. 1–5, and in the four step embodiment, riser 10' depicted in FIGS. 6–10, of the present invention. In both embodiments, the step member 16 comprises the lower two steps of the riser 10, 10' when the riser 10, 10' is in the operational configuration.

Each of the two steps of the second step member 16 has a step frame 80 that is preferably formed of box channel metal component. The step frames 80 are closed and, in a preferred embodiment, are formed in a generally trapezoidal shape, as distinct from the rectangular step frame 60 of the first step member 14. The trapezoidal shape of the step frame 80 accommodates forming a generally curved presentation shape on a stage when utilizing several risers 10 together to form the choral presentation support. Alternatively, in another preferred embodiment, the step frame 80 is formed in a rectangular shape, accommodating a generally in-line choral presentation form utilizing several risers 10 placed on the stage with the sides thereof abutting one another.

A preferably wooden step 82 is supported by the step frame 80. The upper surface 83 of the step 82 may be carpeted as desired. A U-shaped channel bracket 84 that is formed substantially identical to the channel bracket 64 is affixed to the underside of the step 82 with bolts and T-nuts (not shown). The channel bracket 84 is affixed to the pivoting support 86 by toggle bolts 68. The pivoting support 86 presents two upwardly directed support surfaces 89*a*, 89*b* that are generally parallel and spaced apart in elevation when the riser 10 is in its operational configuration. The support surfaces 89*a*, 89*b* support the two step frames 80 at different elevations to form an ascending step structure substantially parallel with the floor upon which the riser 10 is resting when the riser 10 is in its operational configuration. The two upwardly directed support surfaces 89*a*, 89*b* have a pair of bolt receivers 170 defined therein as previously described with respect to support surfaces 69. Coupling of the channel bracket 84 to the pivoting supports 86 is effected by toggle bolts 68, as previously described.

Figure 4:
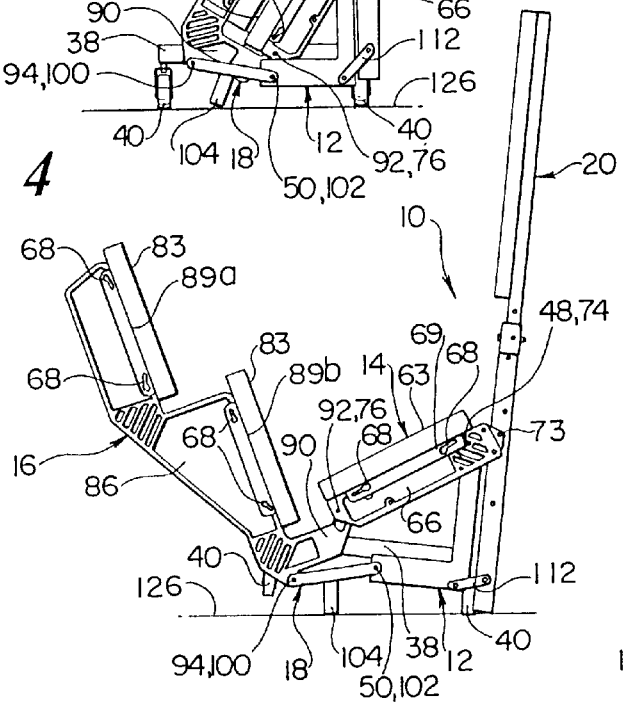
FIG. 4 is a side elevational view of the three step embodiment positioned midway between the stowed configuration and the operational configuration.

An upwardly directed pivot arm 90 is formed at the rearmost portion of the pivoting support 86, as best viewed in FIGS. 3–5. The pivot arm 90 is oriented generally orthogonally with respect to the support surfaces 89*a*, 89*b*. The pivot arm 90 effects the vertical spacing between the top step of the second step member 16 and the step of the first step member 14.

The pivot arm 90 comprises a third bar in the linkage system. Accordingly, the pivot arm 90 has two spaced apart pivot points, the first pivot point 92 and second pivot point 94. The first pivot point 92 is in registry with the second pivot point 76 of the first step member 14. The second step member 16 is pivotally joined to the first step member 14 by a suitable bolt that passes through the first pivot point 92 of the second step member 16 and through the second pivot point 76 of the first step member 14.

The fourth component of the riser 10 and the final component comprising a portion of the linkage system is the bar link 18, as depicted in FIGS. 1–5. The bar link 18 is preferably an elongate metal bar. The bar link 18 has two spaced apart pivot points proximate the two ends thereof. The first pivot point 100 is in registry with and pivotally coupled to the second pivot point 94 of the second step member 16. The second pivot point 102 of the bar link 18 is in registry with and pivotally coupled to the second base pivot point 50 of the base support 30. A relatively short foot attachment 104, formed of a short piece of box section metal stock that is welded to the bar link 18, is disposed at an acute included angle thereto.

The fifth component of the riser 10 is the guard rail 20. The guard rail 20 has two spaced apart generally parallel upright standards 110. A cross brace 111 extends between the two upright standards 110 and is welded thereto. As depicted in FIG. 2, each of the upright standards 110 is pivotally coupled to the vertical second support leg 34 of the base support 30 by the guard rail bracket 70 of the first step member 14 and by the parallel link 112. The parallel link 112 has two spaced apart pivot points 114, 116. The parallel link 112 forms a linkage between the guard rail 20 and the base support 30 and is oriented parallel to the linkage formed between the pivot point 73 and the guard rail bracket 70 and the first pivot point 74 of the first step member 14.

An upright standard extension 118 is pivotally coupled to each of the upright standards 110 by a bolt at hinge point 120. The standard extensions 118 are held in the upright positions as depicted in FIGS. 1 and 2 by slide connector 122. Raising slide connector 122 permits the standard extensions 118 to be folded as desired with respect to the upright standards 110. Alternatively, the guard rail 20 may be formed as a single unit having one piece upright standards 110, as depicted in FIGS. 6–10 for the four step version of the riser 10'.

A rail member 124 is affixed to the forward margin of the upright standards 110 in order to prevent performers from inadvertently stepping off the back side of the first step member 14.

Turning to the four step embodiment of the riser 10' as depicted in FIGS. 6–10, the four step embodiment is designed to share the maximum number of common components possible with the three step embodiment as depicted in FIGS. 1–5. In the description of the four step embodiment of riser 10', like numbers denote like features between the two embodiments.

Figure 6:
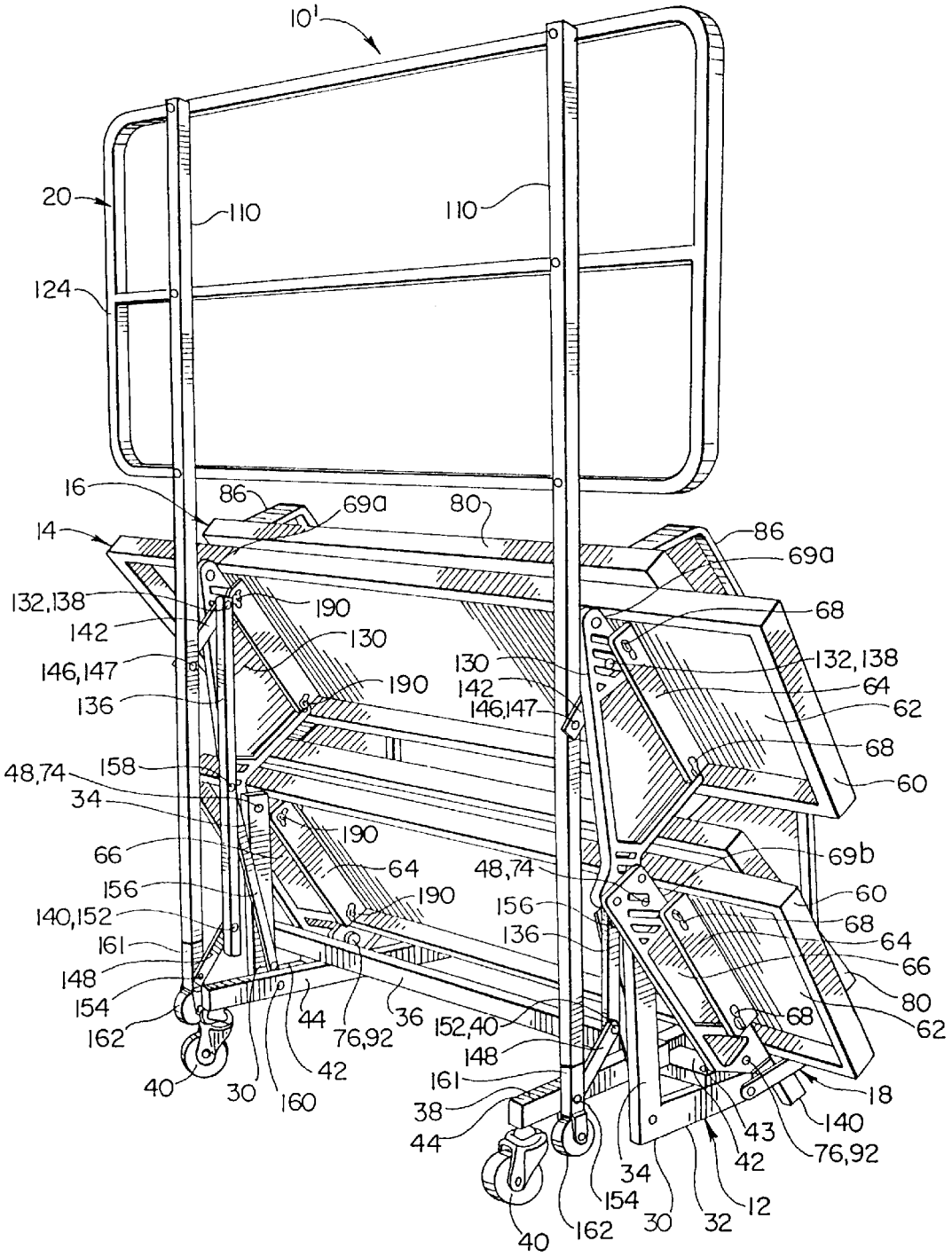
FIG. 6 is rear perspective view of the four step embodiment of the present invention in the stowed configuration.
Figure 7:
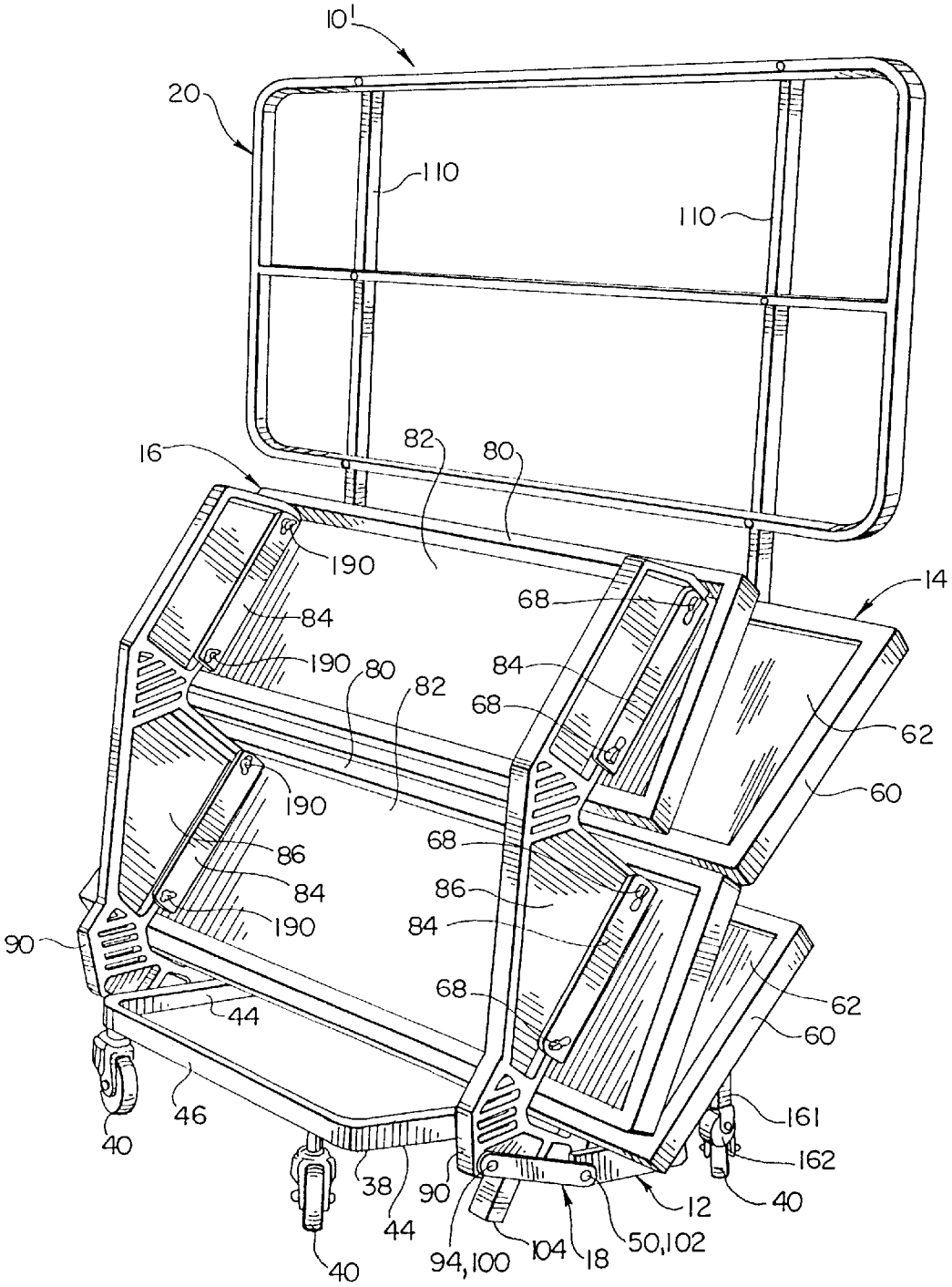
FIG. 7 is a front perspective view of the embodiment depicted in FIG. 6 in the stowed configuration.

Referring to FIGS. 6 and 7, each of the base supports 30 of the base 12 has a first base pivot point 48 and a second base pivot point 50. The distance between the first base pivot point 48 and the second base pivot point 50 comprises the first bar of the linkage system. The first base pivot point 48 is located proximate the upper margin of the vertical second support leg 34. The second base pivot point 50 is located proximate the forward margin of the horizontal first support leg 32.

The second component of the riser 10' is the first step member 14. In the embodiment depicted in FIGS. 6–10, the first step member 14 comprises two steps with one of the two steps being the uppermost and rearmost step of the riser 10' when the riser 10' is in the extended operational configuration.

The first step member 14 has two step frames 60. The step frames 60 are preferably formed in a closed rectangular shape and are preferably constructed of box channel metal components. The step frames 60 support the steps 62, which may be made of wood and carpeted as desired on the upper performing surface 63 thereof.

The first step member 14 has a U-shaped channel bracket 64 proximate the two side margins thereof. Each channel bracket 64 is affixed to the underside of the step 62. The channel bracket 64 is coupled to the pivoting support 66 as previously described with reference to FIGS. 11–13. The pivoting supports 66 provide the main structural support for the lower step 62 of the first step member 14 when the riser 10' is deployed in its operational configuration. Such support is effected by supporting the step 62 on an upwardly directed support surface 69*a*. The two pivoting supports 66 are generally disposed in a parallel and spaced apart relationship.

A pivoting support extension 130 replaces the guard rail bracket 70 of the previously described embodiment. The pivoting support extensions 130 provide the main structural support for the upper step of the first step member 14. The pivoting support extensions 130 are formed in a generally triangular shape and are affixed to the pivoting support 66 by bolts 72 for pivoting therewith during transitions between the operational and stowed configurations. Each of the pivoting support extensions 130 has a pivot point 132. The pivoting support extensions 130 provide the main structural support for the upper step 62 of the first step member 14 when the riser 10 is deployed in its operational configuration by supporting the step 62 on an upwardly directed support surface 69*b*. The two pivoting supports 66 are generally disposed in a parallel and spaced apart relationship.

The first step member 14 comprises the second bar of the linkage system. Accordingly, as depicted in FIG. 6, the pivoting support 66 has a first pivot point 74. The first pivot point 74 is in registry with the first base pivot point 48 of the base 12. The pivoting support 66 is pivotally coupled to the base support 30 by a suitable bolt that passes through the bolt hole (not shown) at the first pivot point 74 of the pivoting support 66 and thence through the first base pivot point 48 of the base support 30.

Each pivoting support 66 has a second pivot point 76 spaced apart from the first pivot point 74. The second pivot point 76 is located proximate the forward end of the pivoting support 66 when the riser 10' is in the operational configuration.

The third component of the riser 10' is the second step member 16. Each of the two steps of the second step member 16 has a step frame 80 that is preferably formed of box channel metal component. The step frames 80 are closed and, in preferred embodiments, are formed in either a generally trapezoidal shape or a rectangular shape as desired.

A preferably wooden step 82 is supported by the step frame 80. The upper surface 83 of the step 82 may be carpeted as desired. A U-shaped channel bracket 84 that is formed substantially identical to the channel bracket 64 is affixed to the underside of the step 82 with tee bolts. The channel bracket 84 is coupled to the pivoting support 86 as previously described with reference to FIGS. 11–13. The pivoting support 86 presents two upwardly directed support surfaces 89*a*, 89*b* that are generally parallel and spaced apart in elevation when the riser 10 is in its operational configuration. The support surfaces 89*a*, 89*b* support two step frames 80 at different elevations to form an ascending step structure.

An upwardly directed pivot arm 90 is formed at the rearmost portion of the pivoting support 86, as best viewed in FIGS. 3–5. The pivot arm 90 is oriented generally orthogonally with respect to the support surfaces 89*a*, 89*b*.

The pivot arm 90 comprises a third bar in the linkage system. Accordingly, the pivot arm 90 has two spaced apart pivot points, the first pivot point 92 and second pivot point 94. The first pivot point 92 is in registry with the second pivot point 76 of the first step member 14. The second step member 16 is pivotally joined to the first step member 14 by a suitable bolt that passes through the first pivot point 92 of the second step member 16 and through the second pivot point 76 of the first step member 14.

The fourth component of the riser 10' and the final component comprising a portion of the linkage system is the bar link 18. The bar link 18 is preferably an elongate metal bar. The bar link 18 has two spaced apart pivot points proximate the two ends thereof. The first pivot point 100 is in registry with and pivotally coupled to the second pivot point 94 of the second step member 16. The second pivot point 102 of the bar link 18 is in registry with and pivotally coupled to the second base pivot point 50 of the base support 30. A relatively short foot attachment 104 formed of a short piece of box section metal stock that is welded to the bar link 18 and is disposed at an angle thereto.

The fifth component of the riser 10' is the guard rail 20. The guard rail 20 has two spaced apart generally parallel upright standards 110. As depicted in FIG. 6, two pivoting vertical supports 136 are included to assist in supporting the rear portion of the riser 10 when the riser 10 is in the operational configuration. The pivoting vertical supports 136 have an upper pivot point 138 that is in registry with the pivot point 132 of the pivoting support extension 130. The vertical support 136 is pivotally coupled to the pivot point 132 of the pivoting support extension 130 and depends therefrom. The vertical support 136 additionally has a lower pivot point 140.

Each of the upright standards 110 is pivotally coupled to the pivoting support extension 130 at pivot point 132 by an upper parallel link 142. The upper parallel link 142 is an elongate bar having pivot points 144, 146 at the two ends thereof. The pivot point 144 is in registry with the pivot point 132 of the pivoting support extension 130 and the upper parallel link 142 is pivotally coupled thereto. The upper parallel link 142 is pivotally coupled to the upright standard 110 at pivot point 147 in the upright standard 110.

A lower parallel link 148 couples the lower portion of the vertical support 136 to the upright standard 110. The lower parallel link 148 has two spaced apart pivot points 152, 154. The lower parallel link 148 is pivotally coupled to the pivot point 140 of the vertical support 136 by a bolt at pivot point 152 and to the upright standard 110 by a bolt at pivot point 154.

A pivoting support bar 156 couples the vertical support 136 to the base at pivot points 158 and 160. The pivoting support bar 156 forms a parallel link with the pivoting support extension 130 acting through pivot points 92, 76 and 132, 138, 144. In a preferred embodiment, a support extension 161, having castors 162 coupled thereto, depend from the lower margin of the upright standards 110. The support extensions 161 are used with the four step version of the riser 10' in order to give the guard rail 20 the required height above the upper step 82. The support extensions 161 have slightly smaller outside dimensions than the inside dimensions of the upright standards 110 so that the support extensions 161 may be received within the upright standards 110. A rail member 124 is affixed to the forward margin of the upright standards 110 in order to prevent performers from inadvertently stepping off the back side of the first step member 14.

A description of the pivoting transition of the three step embodiment of the riser 10 from the stowed configuration to the operating configuration is now made, with reference to FIGS. 3–5. The pivoting transition between the operational configuration and the stowed configuration is effected by the operator exerting a rotational action on the forward portions of the second step member 16. This action both effects the transition of the riser 10 step members 14, 16 between the operational and stowed configurations, and also deploys or stows the guard rail 20 at the same time.

FIG. 3 depicts the riser 10 in its stowed configuration with the guard rail 20 also stowed. The riser 10 is supported by the castors 40 resting on the stage surface 126. The foot attachment 104 of the bar link 18 is not in contact with the stage surface 126. The upper surface 83 of the upper step of the second step member 16 is folded against the upper surface 63 of the step of the first step member 14.

The width of the riser 10 in the stowed configuration, as measured from the front of the castor frame 38 to the rear facing side of the upright standards, 110 is narrow enough to pass comfortably through a normal sized door. Additionally, the height of the riser 10 in a stowed configuration as measured between the stage surface 126 and the top margin of the standard extensions 118 is sufficiently low to also pass comfortably through a normal sized door. Should it be desirable to additionally reduce the height of the riser 10 in the stowed configuration, the slide connector 122 can be raised and the standard extensions 118 folded down along side the upright standards 110.

FIG. 4 depicts the transition of the riser 10 approximately midway between the stowed configuration depicted in FIG. 3 and the operational configuration depicted in FIG. 5. The operator has grasped the forward portions of the second step member 16 and rotated the second step member 16 in a counter clockwise direction. In this position, the foot attachment 104 of the bar link 18 is in contact with the stage surface 126. Typically, at this point the front two castors 40 are caused to rise off the stage surface 126 by downward counterclockwise rotation of the second step member 16 and the forward portion of the riser 10 is supported on the two foot attachments 104, while the rear portion of the riser 10 is supported on the two rearmost castors 40.

Contact of the foot attachment 104 with the stage surface 126 substantially halts the counterclockwise rotation of the bar link 18 that is evident in comparing the depictions thereof in FIGS. 3 and 4. Continued counterclockwise rotation of second step member 16 causes the first step member 14 to continue in a clockwise rotation about the first pivot point 74. The rotation of the second step member 16 with respect to the first step member 14, about the second pivot point 94 and second pivot point 76, ultimately causes the bar link 18 to rotate in a clockwise direction. Such rotation results in the disengagement of the foot attachment 104 with the stage surface 126. As the foot attachment 104 disengages, the forward portion of the riser 10 is lowered and the front castors 40 again come to a position supported on the stage surface 126 as depicted in FIG. 5.

The rotation of the pivoting support 66 of the first step member between the stowed configuration depicted in FIG. 3 and the operational configuration depicted in FIG. 5 results in the deployment of the guard rail 20 by translation thereof in a clockwise arc through approximately sixty degrees, by means of the parallel link action. This translation positions the guard rail 20 a distance to the rear of the rear edge of the step of the first step member 14 and brings the lower margin of the upright standards 110 into contact with the stage surface 126.

Figure 8:
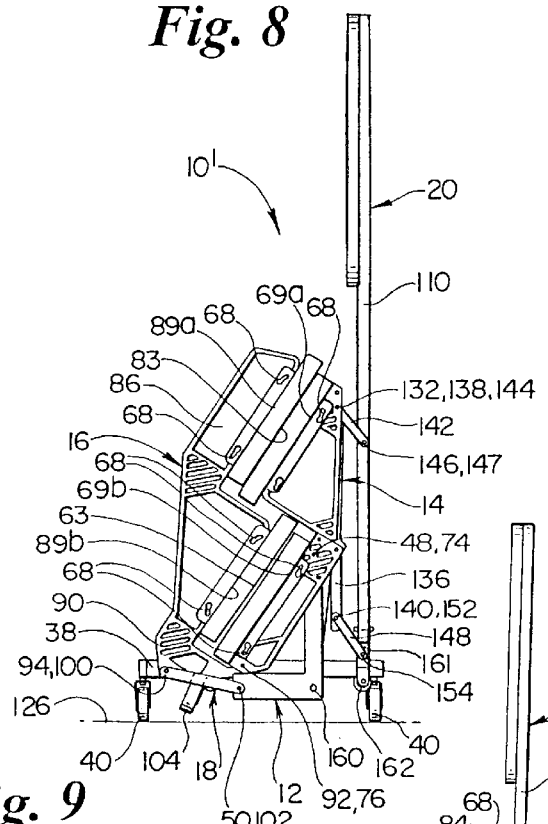
FIG. 8 is a side elevational view of the four step embodiment in the stowed configuration.
Figure 9:
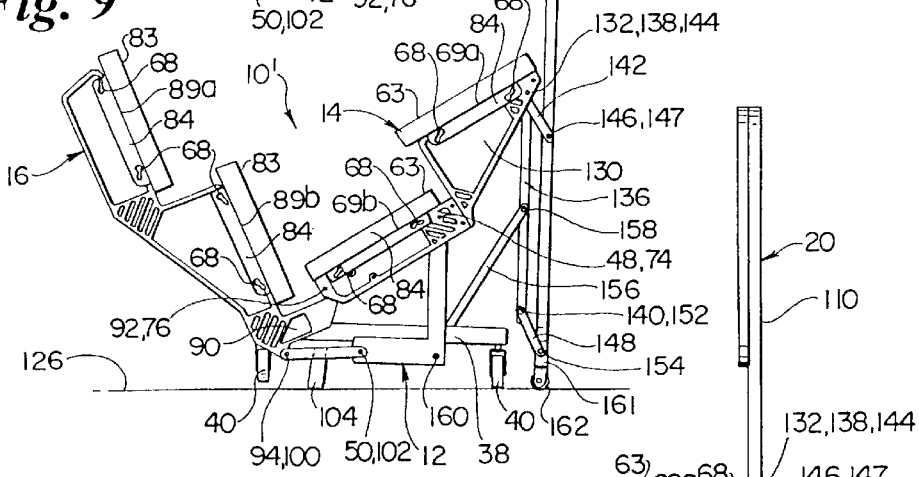
FIG. 9 is a side elevational view of the four step embodiment positioned midway between the stowed configuration and the operational configuration.
Figure 10:
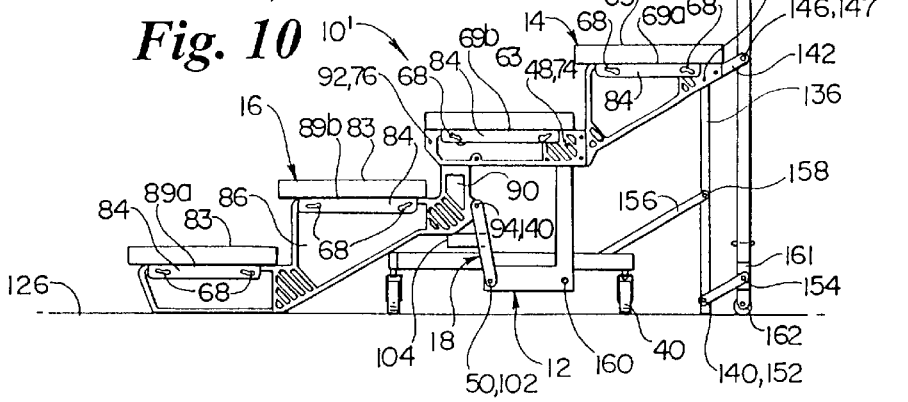
FIG. 10 is a side elevational view of the four step embodiment in the operational configuration.

Reference is now made to FIGS. 8–10 for a description of the operation of the four step embodiment of the riser 10'. FIG. 8 depicts the riser 10' in its stowed configuration. The riser 10' is supported by the castors 40 resting on the stage surface 126. The foot attachment 104 of the bar link 18 is not in contact with the stage surface 126. The upper surfaces 83 of the two steps of the second step member 16 are folded against the upper surfaces 63 of the two steps of the first step member 14. In a manner as described for the three step embodiment, the four step embodiment of the riser 10 is narrow and low enough to pass comfortably through a normal sized door when in the stowed configuration depicted in FIG. 8.

FIG. 9 depicts the transition of the riser 10' approximately midway between the stowed configuration depicted in FIG. 8 and the operational configuration depicted in FIG. 10. Since the linkage system is the same in the three step and the four step embodiments of the riser 10', the transition from the stowed configuration and the operational configuration is substantially the same. In this position, the foot attachment 104 of the bar link 18 is in contact with the stage surface 126 and downward counterclockwise rotation of the second step member 16 has caused the front castors 40 to rise off of the stage surface 126.

Contact of the foot attachment 104 with the stage surface 126 substantially halts the counterclockwise rotation of the bar link 18 that is evident in comparing the depictions thereof in FIGS. 3 and 4. Continued counterclockwise rotation of second step member 16 causes the first step member 14 to continue in a clockwise rotation about the first pivot point 74. The rotation of the second step member 16 with respect to the first step member 14 about the second pivot point 94 and second pivot point 76, ultimately causes the bar link 18 to rotate in a clockwise direction. Such rotation results in the disengagement of the foot attachment 104 with the stage surface 126. As the foot attachment 104 disengages, the forward portion of the riser 10' is lowered and the front castors 40 again come to a position supported on the stage surface 126 as depicted in FIG. 10.

The rotation of the pivoting support 66 of the first step member 14 between the stowed configuration depicted in FIG. 8 and the operational configuration depicted in FIG. 10, results in the translation of the guard rail 20. As depicted in FIG. 9, the guard rail 20 is caused to rotate from the stowed configuration of FIG. 8 to the position with the castors 162 in rotational contact with the stage surface 126. Continued counterclockwise rotation of second step member 16 causes the castor 162 to travel rearward with respect to the riser 10 with the castors 162 rolling on the stage surface 126. By parallel link action, the rearward travel causes the vertical support 136 to translate rearward and downward until the lower margin of the vertical support 136 is in contact with the stage surface 126, supporting the rear portion of the uppermost step 62 of the first step member 14. This translation positions the guard rail 20 a distance to the rear of the rear edge of the uppermost step 62 of the first step member 14.

Figure 14:
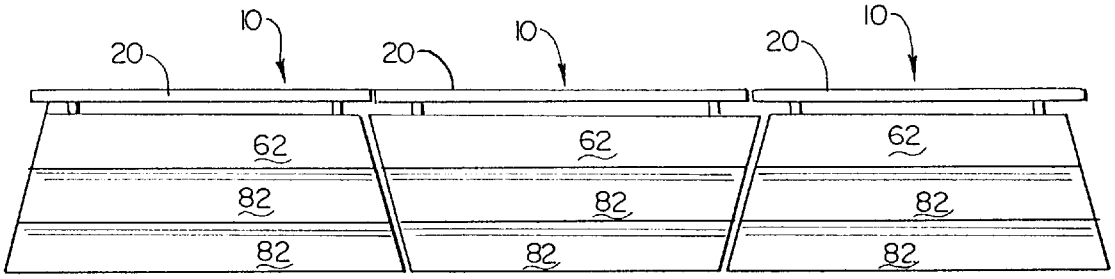
FIG. 14 is a simplified top plan view of a plurality of risers with the steps thereof configured to present a straight stage presentation form.
Figure 15:
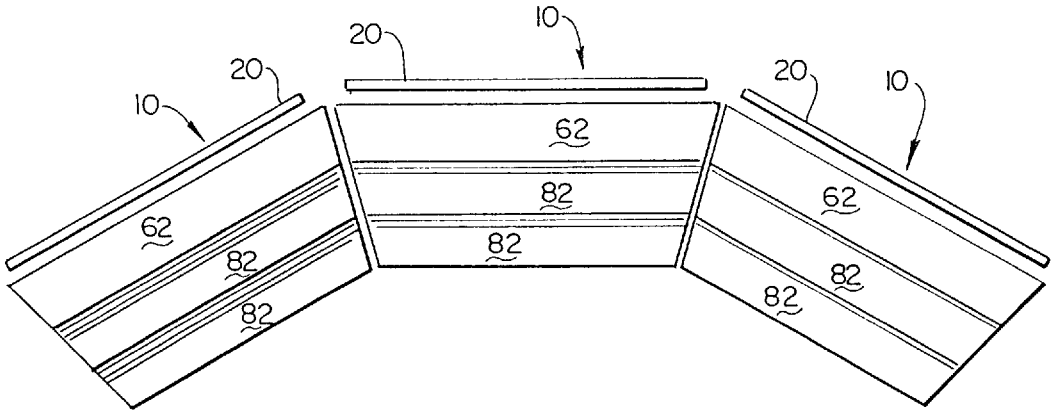
FIG. 15 is a simplified top plan view of a plurality of risers with the steps thereof configured to present a curved stage presentation form.

A stage presentation may, for example, take a number of different forms, as depicted in FIGS. 14–15. The forms depicted each use three of the three-step configuration risers 10. With the risers 10 and 10' of the present invention, the steps 62, 82 are readily reversible in order to alter the stage presentation form. In FIG. 14, the center riser 10 has the steps 62, 82 disposed thereon with the narrow portion of the trapezoidal shape facing the front of the riser 10. The two flanking risers 10 each have the steps 62, 82 disposed thereon with the wide portion of the trapezoidal shape facing the front of the risers 10. When the three risers 10 are placed with the sides thereof abutting, the effect is to create a straight stage presentation form.

Referring now to FIG. 15, the steps 62, 82 of the two flanking risers 10 of FIG. 14 have had the disposition of steps 62, 82 reversed such that the steps 62, 82 are disposed thereon with the narrow portion of the trapezoidal shape facing the front of the two flanking risers 10. When the three risers 10 are arranged on the stage with the sides thereof abutting, the effect is to create a generally curved stage presentation form.

The flexibility to readily change stage presentation forms results from the ability to readily reverse the disposition of the steps 62, 82 with respect the risers 10. This flexibility is afforded by the quick release type of apparatus used for coupling the steps 62, 82 to the pivoting support 66, 86. Referring to FIG. 12, the step 62 is partially through a reconfiguration. The toggle bolt 68 (not shown) has been removed from the bore 192. The second toggle bolt has been put in the unlocked configuration, releasing the compressive force on the channel bracket 64. The step 62 may then be moved as indicated by the arrow 194 to free the toggle bolt 68 from the receiver 170, depicted in phantom. The step 62 is then rotated 180 degrees to the reverse orientation and reengaged to the pivoting support 66 by means of the reverse of the removal procedure just described. This procedure is repeated for each of the steps 62, 82 of the risers 10, 10'. Reversing all the steps 62, 82 effects the configuration change apparent in the two flanking risers 10 as depicted in FIGS. 14, 15.

What is claimed is:

1. A portable choral riser adapted to be supported on a stage surface, having;

a frame member having a plurality of stage surface engaging wheels disposed thereon for facilitating movement of the choral riser over said supporting surface;

a first step assembly being operably supportively coupled to the frame member, the first step assembly including a first step presenting a first step upper surface;

a second step assembly including a second step presenting a second step upper surface, said second step assembly being operably pivotally coupled to the first step assembly;

a base operably pivotally coupled to the first step assembly; and a coupling mechanism operably pivotally coupled to the second step assembly and the base, whereby the first step assembly and the second step assembly are shiftable between a stowed configuration wherein said first and second step upper surfaces are oriented in generally facing orientation to each other and an operating configuration wherein said first and second step upper surfaces are deployed in a generally upward facing orientation, the choral riser comprising:

the disposition of the first step and the second step with respect to the base being readily reversible to effect a plurality of planform forms of the choral riser.

2. A choral riser adapted to be supported on a stage surface as claimed in claim 1 wherein the steps are trapezoidal in planform.

3. A choral riser adapted to be supported on a stage surface as claimed in claim 2 wherein the quick disconnect type apparatus includes an over-center toggle bolt.

4. A choral riser adapted to be supported on a stage surface as claimed in claim 3 wherein the base includes a plurality of step supporting surfaces, each of the plurality of step supporting surfaces having at least two receivers, the receivers having a bolt bearing portion for receiving the toggle bolt therein and having an open side coupled to the bolt bearing portion open side defined in part by a lip, the lip retainingly engaging the toggle bolt for retaining the toggle bolt within the bolt bearing portion.

5. A choral riser adapted to be supported on a stage surface as claimed in claim 4 wherein the step further includes a bracket affixed thereto, the bracket having at least one bore defined therein, the at least one bore being in registry with the bolt bearing portion of a receiver when the step is supported by the plurality of step supporting surfaces.

6. A choral riser adapted to be supported on a stage surface as claimed in claim 5 wherein the toggle bolt has a shank having a threaded first end and a second end having a handle pivotally coupled thereto, the handle having a cam surface defined thereon for compressively engaging the step bracket, and further including a threaded coupler for threadedly engaging the threaded first end of the shank.

7. A portable choral riser adapted to be supported on a supporting surface, having:

a frame member having a plurality of supporting surface engaging wheels disposed thereon for facilitating movement of the choral riser over said supporting surface;

a first step asembly being operably supportively coupled to the frame member, the first step assembly including a first step presenting a first step upper surface;

a second step assembly including a second step presenting a second step upper surface, said second step assembly being operably pivotally coupled to the first step assembly;

a base operably pivotally coupled to the first step assembly; and a coupling mechanism operably pivotally coupled to the second step assembly and the base, whereby the first step assembly and the second step assembly are shiftable between a stowed configuration wherein said first and second step upper surfaces are oriented in generally facing orientation to each other and an operating configuration wherein said first and second step upper surfaces are deployed in a generally upward facing orientation, the choral riser comprising:

the first step being readily removable from the first step assembly and reversible with respect thereto and the second step being readily removable from the second step assembly and reversible with respect thereto for defining a plurality of riser planform shapes.

8. The choral riser of claim 7 wherein the first and second step members are pivotable between a stowed configuration and an operational configuration, the operational configuration being a disposition in which the at least one step of the first step assembly and the at least one step of the second step assembly present an ascending succession of steps.

9. The choral riser of claim 4 wherein the at least one step of the first step assembly and the at least one step of the second step assembly are trapezoidal in planform.

10. A choral riser adapted to be supported on a stage surface, comprising:

a base; and a plurality of steps being trapezoidal in planform and being removably coupled to the base by means of quick disconnect type apparatus including an over-center toggle bolt, the disposition of the steps with respect to the base being readily reversible to effect a plurality of planform forms of the choral riser.

11. A choral riser adapted to be supported on a stage surface as claimed in claim 10 wherein the base includes a plurality of step supporting surfaces, each of the plurality of step supporting surfaces having at least two receivers, the receivers having a bolt bearing portion for receiving the toggle bolt therein and having an open side coupled to the bolt bearing portion open side defined in part by a lip, the lip retainingly engaging the toggle bolt for retaining the toggle bolt within the bolt bearing portion.

12. A choral riser adapted to be supported on a stage surface as claimed in claim 11 wherein the step further includes a bracket affixed thereto, the bracket having at least one bore defined therein, the at least one bore being in registry with the bolt bearing portion of a receiver when the step is supported by the plurality of step supporting surfaces.

13. A choral riser adapted to be supported on a stage surface as claimed in claim 12 wherein the toggle bolt has a shank having a threaded first end and a second end having a handle pivotally coupled thereto, the handle having a cam surface defined thereon for compressively engaging the step bracket, and further including a threaded coupler for threadedly engaging the threaded first end of the shank.

* * * * *

UNITED STATES PATENT AND TRADEMARK OFFICE

CERTIFICATE OF CORRECTION

PATENT NO. : 5,901,505

DATED : May 11, 1999

INVENTOR(S) : Dettmann et al.

It is certified that error appears in the above-identified patent and that said Letters Patent is hereby corrected as shown below:

Column 1, line 28, after "plurality" insert --of--.

Column 2, lines 47 and 58, after "is" insert --a--.

Column 3, line 44, delete "is" and insert --as--.

Column 11, line 32, after "respect" insert --to--.

Column 13, line 7, delete "4" and insert --7--.

Signed and Sealed this

Thirtieth Day of November, 1999

*Attest:*

*Attesting Officer*

Q. TODD DICKINSON

*Acting Commissioner of Patents and Trademarks*